US008677963B2

(12) United States Patent
Stoltz-Douchet et al.

(10) Patent No.: US 8,677,963 B2
(45) Date of Patent: Mar. 25, 2014

(54) ELECTRICAL CAMSHAFT PHASER WITH ENERGY RECOVERY

(75) Inventors: Sebastien Stoltz-Douchet, Basse-Ham (FR); Sebastien Mafrica, Musson (BE)

(73) Assignee: Delphi Technologies, Inc., Troy, MI (US)

( * ) Notice: Subject to any disclaimer, the term of this patent is extended or adjusted under 35 U.S.C. 154(b) by 10 days.

(21) Appl. No.: 13/580,685

(22) PCT Filed: Jan. 21, 2011

(86) PCT No.: PCT/EP2011/050861

§ 371 (c)(1),
(2), (4) Date: Sep. 10, 2012

(87) PCT Pub. No.: WO2011/104051

PCT Pub. Date: Sep. 1, 2011

(65) Prior Publication Data

US 2013/0008398 A1 Jan. 10, 2013

(30) Foreign Application Priority Data

Feb. 24, 2010 (EP) ..... 10154551

(51) Int. Cl.
*F01L 1/34* (2006.01)

(52) U.S. Cl.
USPC ..... 123/90.17; 123/90.11; 123/90.15; 74/640; 464/160; 475/5

(58) Field of Classification Search
USPC ..... 123/90.11, 90.15, 90.17; 74/640; 464/160; 475/5
See application file for complete search history.

(56) References Cited

U.S. PATENT DOCUMENTS

| | | | |
|---|---|---|---|
| 3,285,099 | A | 11/1966 | Parks, Jr. et al. |
| 4,451,098 | A | 5/1984 | Farley et al. |
| 4,770,060 | A | 9/1988 | Elrod et al. |
| 4,771,742 | A | 9/1988 | Nelson et al. |
| 5,417,186 | A | 5/1995 | Elrod et al. |
| 6,257,186 | B1 | 7/2001 | Heer |

(Continued)

FOREIGN PATENT DOCUMENTS

| | | |
|---|---|---|
| CN | 1 808 854 | 7/2006 |
| EP | 2 194 241 | 6/2010 |
| WO | 2009/013074 | 1/2009 |

OTHER PUBLICATIONS

International Search Report dated Jun. 20, 2011.

(Continued)

*Primary Examiner* — Ching Chang
(74) *Attorney, Agent, or Firm* — Thomas N. Twomey

(57) ABSTRACT

An electrical camshaft phaser arrangement for controllably varying the phase relationship between a crankshaft and a camshaft in an internal combustion engine includes an adjusting gear drive unit formed as a three shafts transmission having a drive shaft connected with the crankshaft, an output shaft connected with the camshaft, and an adjusting shaft connected with the control shaft of an electrical machine. The electrical machine allows phasing the camshaft with regards to the crankshaft by increasing or decreasing control shaft speed, the control shaft being spinning during phase holding modes. The adjusting gear drive unit is configured such that an energy recovering mode is provided wherein a braking torque is applied to the control shaft in order to generate electrical energy.

9 Claims, 6 Drawing Sheets

BASELINE SPLINES ARRANGEMENT

(56) References Cited

U.S. PATENT DOCUMENTS

| | | | | |
|---|---|---|---|---|
| 6,302,073 | B1 | 10/2001 | Heer | |
| 6,328,006 | B1 | 12/2001 | Heer | |
| 7,421,990 | B2 | 9/2008 | Taye et al. | |
| 7,647,904 | B2 * | 1/2010 | Farah et al. | 123/90.17 |
| 7,673,598 | B2 | 3/2010 | Schaefer et al. | |
| 2011/0030631 | A1 | 2/2011 | David et al. | |
| 2011/0030632 | A1 | 2/2011 | David et al. | |
| 2011/0277713 | A1 | 11/2011 | David et al. | |
| 2011/0315102 | A1 | 12/2011 | David et al. | |
| 2012/0024247 | A1 | 2/2012 | David et al. | |
| 2012/0145104 | A1 | 6/2012 | David et al. | |

OTHER PUBLICATIONS

U.S. Appl. No. 13/112,199, entitled "Axially Compact Coupling for a Camshaft Phaser Actuated by Electric Motor", filed May 20, 2011.

U.S. Appl. No. 13/155,685, entitled "Harmonic Drive Camshaft Phaser Using Oil for Lubrication", filed Jun. 8, 2011.

U.S. Appl. No. 13/184,975, entitled "Harmonic Drive Camshaft Phaser With Lock Pin for Selectively Preventing a Change in Phase Relationship", filed Jul. 18, 2011.

U.S. Appl. No. 13/249,286, entitled "Harmonic Drive Camshaft Phaser With a Harmonic Drive Ring to Prevent Ball Cage Deflection", filed Sep. 30, 2011.

* cited by examiner

INVERTED SPLINES ARRANGEMENT

BASELINE SPLINES ARRANGEMENT

ELECTROMECHANICAL BRAKE + SPRING

| | ADVANCE (TIME IN s) | RETARD (TIME IN s) |
|---|---|---|
| BASELINE | 2.085 | INF |
| INVERTED | INF | 2.355 |

FIG. 7.

eMOTOR INERTIA + SPRING

| | ADVANCE (TIME IN s) | RETARD (TIME IN s) |
|---|---|---|
| BASELINE | 4.42 | 3.97 |
| INVERTED | 2.935 | 5.035 |

FIG. 8.

ELECTRICAL CAMSHAFT PHASER WITH ENERGY RECOVERY

TECHNICAL FIELD

The present invention relates to camshaft phasers for varying the timing of combustion valves in internal combustion engines by varying the phase relationship between an engine's crankshaft and camshaft; more particularly, to oil-less camshaft phasers wherein an adjusting gear drive unit is controlled by an electric motor (eMotor) to vary the phase relationship, also referred to herein as an "electric variable cam phaser" (eVCP).

BACKGROUND OF THE INVENTION

Camshaft phasers ("cam phasers") for varying the timing of combustion valves in an internal combustion engines are well known. A first element, known generally as a sprocket element, is driven by a chain, belt, or gearing from an engine's crankshaft. A second element, known generally as a camshaft plate, is mounted to the end of an engine's camshaft.

When such cam phasers are electrically actuated, a triple shaft arrangement such as planetary gears or a harmonic drive arrangement is provided. Examples of three shafts transmissions suitable for use with a cam phaser comprise planetary gear systems, with a sun gear, planetary gears mounted on a planet carrier and a ring gear, or harmonic drive systems with a wave generator, flex-spline and circular spline.

U.S. Pat. No. 7,421,990 B2, herein incorporated by reference, discloses an eVCP comprising first and second harmonic gear drive units facing each other along a common axis of the camshaft and the phaser and connected by a common flexible spline (flexspline). The first, or input, harmonic drive unit is driven by an engine sprocket, and the second, or output, harmonic drive unit is connected to an engine camshaft.

A current tendency in the automotive industry is to optimize energy consumption in automotive vehicles.

It is a principal object of the present invention to provide an eVCP for optimization of energy consumption.

SUMMARY OF THE INVENTION

The present invention proposes an electrical camshaft phaser arrangement for controllably varying the phase relationship between a crankshaft and a camshaft in an internal combustion engine, comprising an adjusting gear drive unit formed as a three shafts transmission, comprising a drive shaft connected with the crankshaft, an output shaft connected with the camshaft, and an adjusting shaft connected with the control shaft of an electrical machine, the electrical machine allowing phasing the camshaft with regards to the crankshaft by increasing or decreasing control shaft speed, control shaft being spinning during phase holding modes, characterized in that the adjusting gear drive unit is configured such that an energy recovering mode is provided wherein a braking torque is applied to the control shaft in order to generate electrical energy, said braking torque being applied to the control shaft during phase holding modes, said braking torque compensating the camshaft friction torque on the control shaft.

Thanks to the invention, energy loss such as friction on the camshaft can be recovered through the adjusting gear drive unit. Thus, when a motoring torque on the control shaft is generated by friction in the driven mechanism (camshaft) and rotates in the same direction as the control shaft, the electrical machine switches from an electrical motor mode to a generator mode. In this configuration, electrical energy can be recovered.

According to advantageous features of the present invention:

the adjusting gear drive unit is configured such that the control shaft is rotating in an opposite direction to the camshaft in order to provide electrical energy generation by recovery of mechanical camshaft frictions losses;

the adjusting gear drive unit is a harmonic gear drive unit including a circular spline and a dynamic spline, a flexspline disposed within said circular spline and said dynamic spline, and a wave generator disposed within said flexspline, said electrical machine being connected to said wave generator;

at least one spring operationally connected to said circular spline and to said dynamic spline for urging one of said circular and dynamic splines to move the camshaft phaser to a default rotational position said electrical machine is a DC axial-flux motor.

It has to be noted that, when a harmonic gear drive unit is used, it is easily possible to swap the arrangement of the circular spline with regard to the dynamic spline in order to choose in which functioning mode of the cam phaser arrangement energy loss will be recovered.

The present invention also proposes a control method for an electrical camshaft phaser arrangement as described above, comprising the steps of:

increasing or decreasing control shaft speed in order to phase the camshaft, maintaining control shaft speed in order to hold a phase between the crankshaft and the camshaft, characterized by the further step of energy loss recovering by applying a braking torque on the control shaft in order to generate electrical energy, said energy loss recovering step being implemented during phase holding in order to compensate camshaft friction torque.

BRIEF DESCRIPTION OF THE DRAWINGS

The present invention will now be described, by way of example, with reference to the accompanying drawings, in which:

FIG. 7 is a first table showing advance and retard times for exemplary baseline and inverted eVCPs when the harmonic drive unit is provided with a mechanical biasing spring in accordance with the present invention and the eMotor is provided with an electromagnetic brake;

FIG. 8 is a second table showing advance and retard times for exemplary baseline and inverted eVCPs when the harmonic drive unit is provided with a mechanical biasing spring and the eMotor has no electromagnetic brake.

Figure 1:
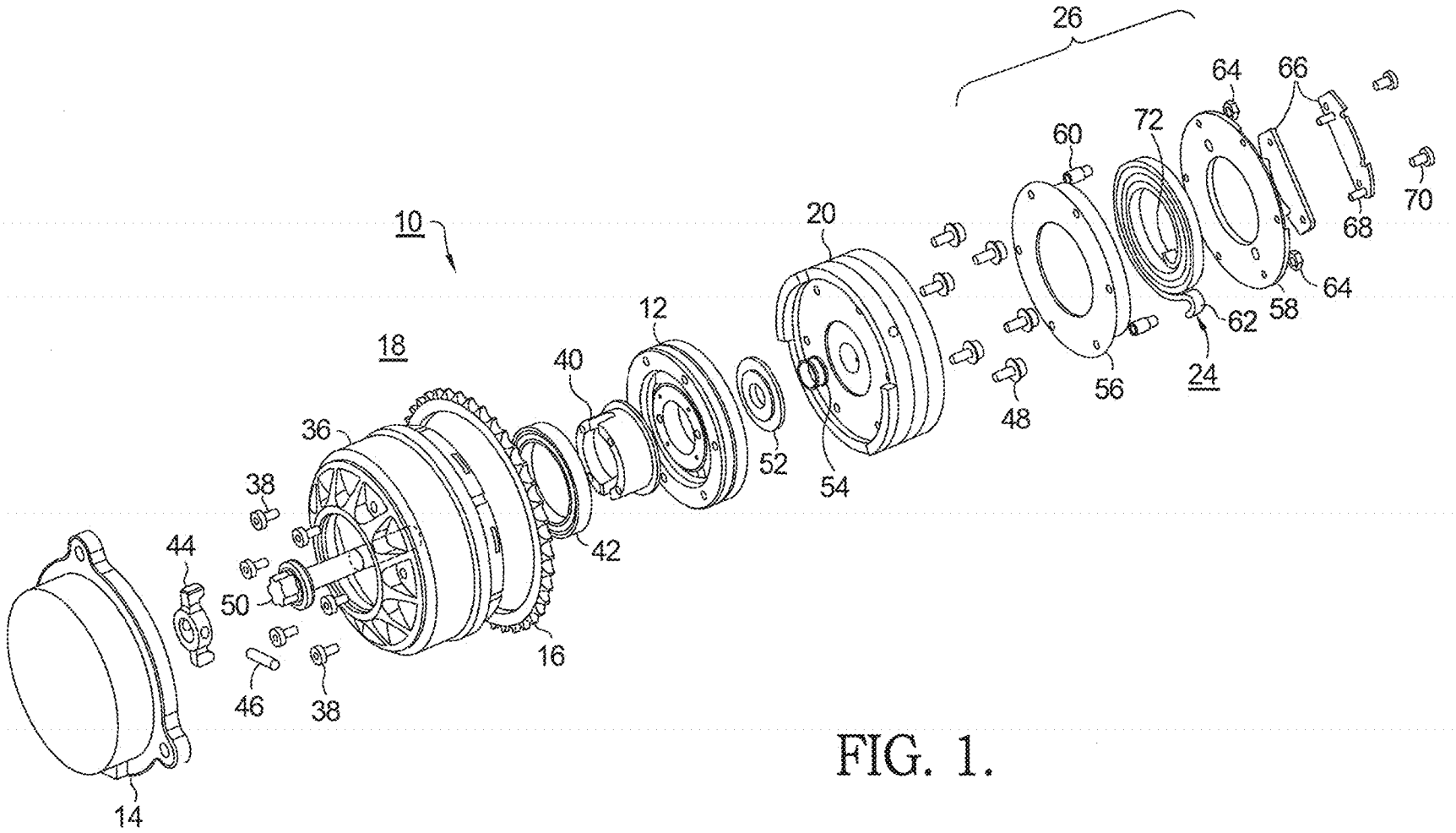
FIG. 1 is an exploded isometric view of an eVCP in accordance with the present invention.

The exemplifications set out herein illustrate currently preferred embodiments of the invention. Such exemplifications are not to be construed as limiting the scope of the invention in any manner.

DESCRIPTION OF THE PREFERRED EMBODIMENTS

Referring to FIGS. 1 through 4, an eVCP 10 in accordance with the present invention comprises an adjusting gear drive unit 12 that is preferably a flat harmonic gear drive unit 12; an electrical machine 14 that is preferably a DC electric motor (eMotor), operationally connected to harmonic gear drive unit 12; an input sprocket 16 operationally connected to harmonic gear drive unit 12 and drivable by a crankshaft of engine 18; an output hub 20 attached to harmonic gear drive unit 12 and mountable to an end of an engine camshaft 22; and a bias spring 24 operationally disposed between output hub 20 and input sprocket 16. Spring 24 may be a component of a spring cassette 26. eMotor 14 may be an axial-flux DC motor.

Harmonic gear drive unit 12 comprises an outer first spline 28 which may be either a circular spline or a dynamic spline as described below; an outer second spline 30 which is the opposite (dynamic or circular) of first spline 28 and is coaxially positioned adjacent first spline 28; a flexspline 32 disposed radially inwards of both first and second splines 28,30 and having outwardly-extending gear teeth disposed for engaging inwardly-extending gear teeth on both first and second splines 28,30; and a wave generator 34 disposed radially inwards of and engaging flexspline 32.

Flexspline 32 is a non-rigid ring with external teeth on a slightly smaller pitch diameter than the circular spline. It is fitted over and elastically deflected by wave generator 34.

The circular spline is a rigid ring with internal teeth engaging the teeth of flexspline 32 across the major axis of wave generator 34.

The dynamic spline is a rigid ring having internal teeth of the same number as flexspline 32. It rotates together with flexspline 32 and serves as the output member. Either the dynamic spline or the circular spline may be identified by a chamfered corner 33 at its outside diameter to distinguish one spline from the other.

As is disclosed in the prior art, wave generator 34 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32 (actually two waves 180° apart, corresponding to opposite ends of the major ellipse axis of the disc).

During assembly of a harmonic gear drive unit 12, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator). Harmonic gear drive unit 12 is thus a high-ratio gear transmission; that is, the angular phase relationship between first spline 28 and second spline 30 changes by 2% for every revolution of wave generator 34.

Of course, as will be obvious to those skilled in the art, the circular spline rather may have slightly more teeth than the dynamic spline has, in which case the rotational relationships described below are reversed.

Figure 2:
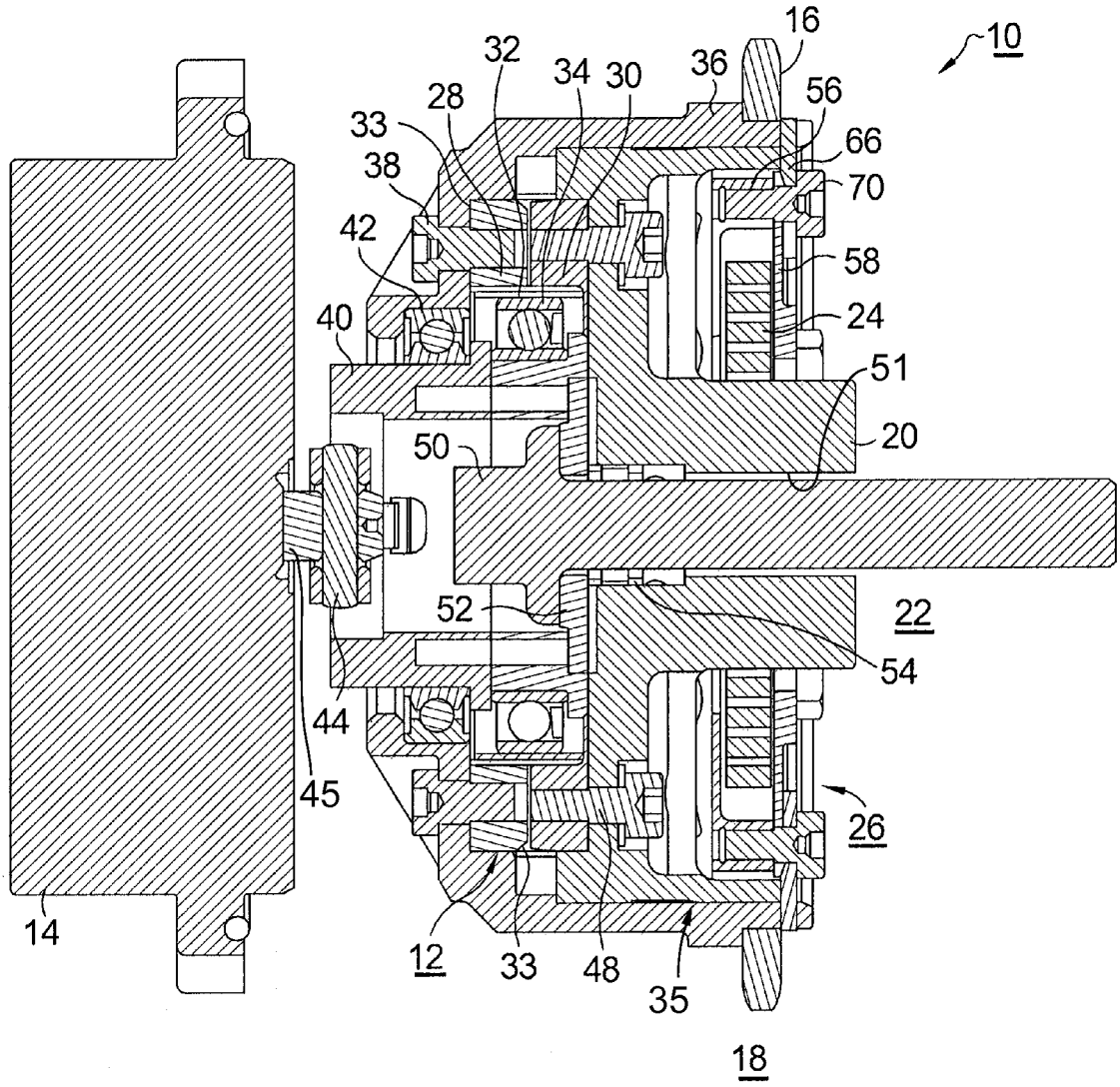
FIG. 2 is an elevational cross-sectional view of the eVCP shown in FIG. 1.
Figure 3:
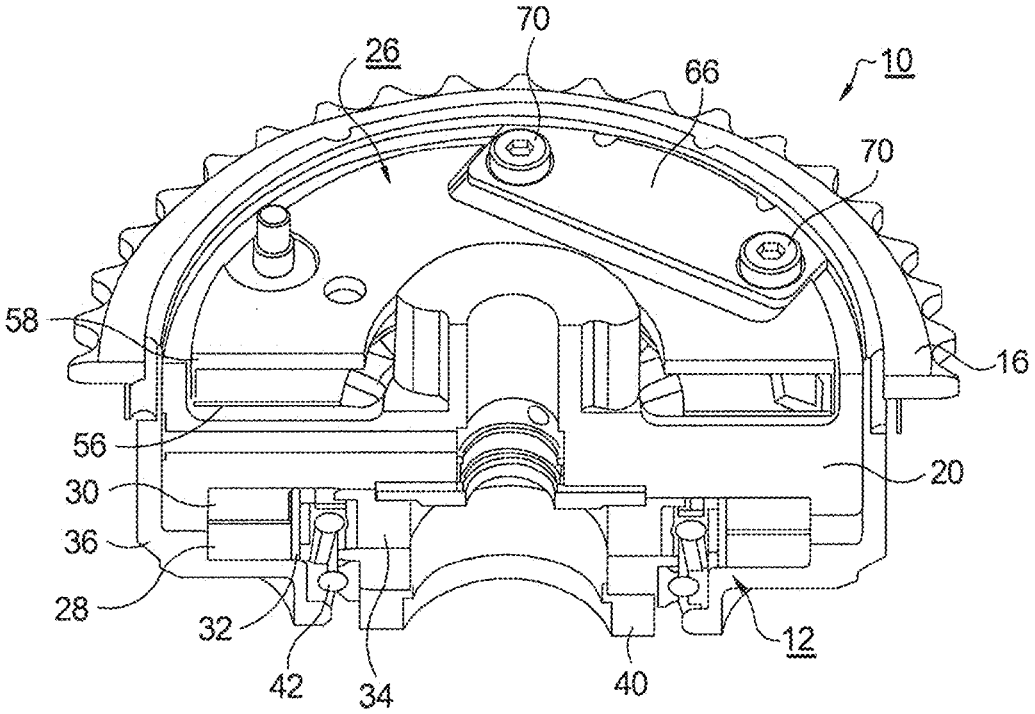
FIG. 3 is a perspective view in cross-section of the eVCP shown in FIGS. 1 and 2, with the eMotor, coupling, and bias spring omitted for clarity.
Figure 4:
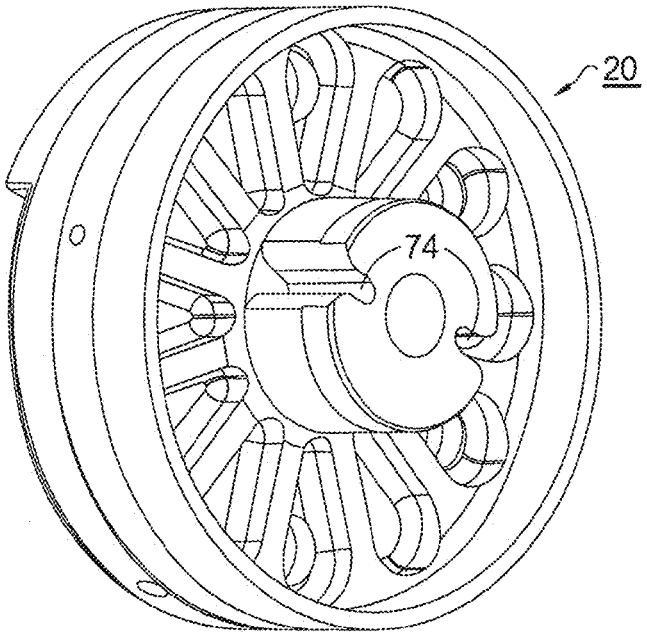
FIG. 4 is a perspective view of the eVCP hub showing detents for engaging the inner tang of the bias spring.

Still referring to FIGS. 1 and 2, sprocket 16 is supported by a generally cup-shaped sprocket housing 36 that is fastened by bolts 38 to first spline 28. A coupling adaptor 40 is mounted to wave generator 34 and extends through sprocket housing 36, being supported by bearing 42 mounted in sprocket housing 36. A coupling 44 mounted to the motor shaft, or control shaft 45, of eMotor 14 and pinned thereto by pin 46 engages coupling adaptor 40, permitting wave generator 34 to be rotationally driven by eMotor 14, as may be desired to alter the phase relationship between first spline 28 and second spline 30.

Hub 20 is fastened to second spline 30 by bolts 48 and may be secured to camshaft 22 by a central through-bolt 50 extending through an axial bore 51 in hub 20, and capturing a stepped thrust washer 52 and a filter 54 recessed in hub 20. In an eVCP, it is necessary to limit radial run-out between the input hub and output hub. In the prior art, this has been done by providing multiple roller bearings to maintain concentricity between the input and output hubs. Referring to FIG. 2, in one aspect of the invention, radial run-out is limited by a singular journal bearing interface 35 between housing 36 (input hub) and output hub 20, thereby reducing the overall axial length of eVCP 10 and its cost to manufacture over a prior art eVCP having multiple roller bearings.

Spring cassette 26 includes a bottom plate 56 and a top plate 58 disposed on opposite sides of spring 24. Shouldered spring spacers 60 extending between bottom and top plates 58 create an operating space for spring 24 and also provide an anchor for outer tang 62 on spring 24. Spring spacers 60 pass through top plate 58 and are secured by nuts 64. First and second retainer plates 66 may be used to secure cassette 26 to housing 36. For example, first and second retainer plates 66 may be positioned on top plate 58 by studs 68 and secured to bottom plate 56 by bolts 70. Retainer plates 66 may extend radially beyond the edges of top plate 58 to engage an annular groove or slots formed in sprocket housing 36, thereby axially positioning and locking cassette 26 in place on hub 20 such that the inner tang 72 of spring 24 engages one of two alternate detents 74 formed in hub 20. Retainer plates 66 exemplarily demonstrate only one arrangement for attaching cassette 26 to eVCP 10; obviously, all other alternative attaching arrangements are fully comprehended by the invention.

In the event of an eMotor malfunction, spring 24 is biased to back-drive harmonic gear drive unit 12 without help from eMotor 14 to a rotational position of second spline 30 wherein engine 18 will start or run, which position may be at one of the extreme ends of the range of authority or, in one aspect of the invention, intermediate of the phaser's extreme ends of its rotational range of authority. For example, the rotational range of travel in which spring 24 biases harmonic gear drive unit 12 may be limited to something short of the end stop position of the phaser's range of authority. Such an arrangement would be useful for engines requiring an intermediate park position for idle or restart.

Figure 6:
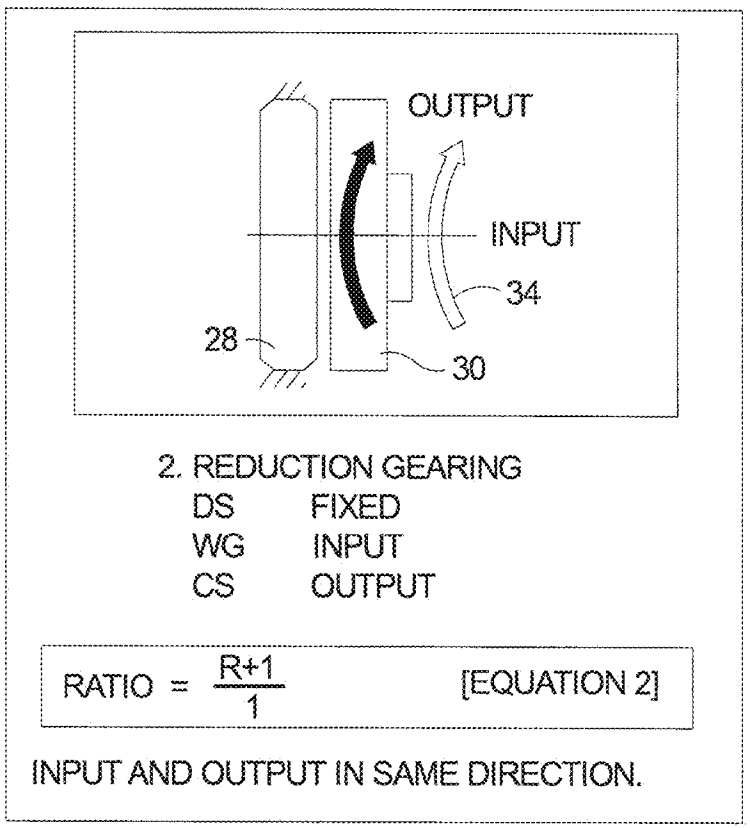
FIG. 6 is a schematic drawing showing a second gearing relationship in an eVCP, referred to herein as the inverted splines arrangement, wherein the circular spline drives the camshaft and the dynamic spline is driven by the sprocket.
Figure 5:
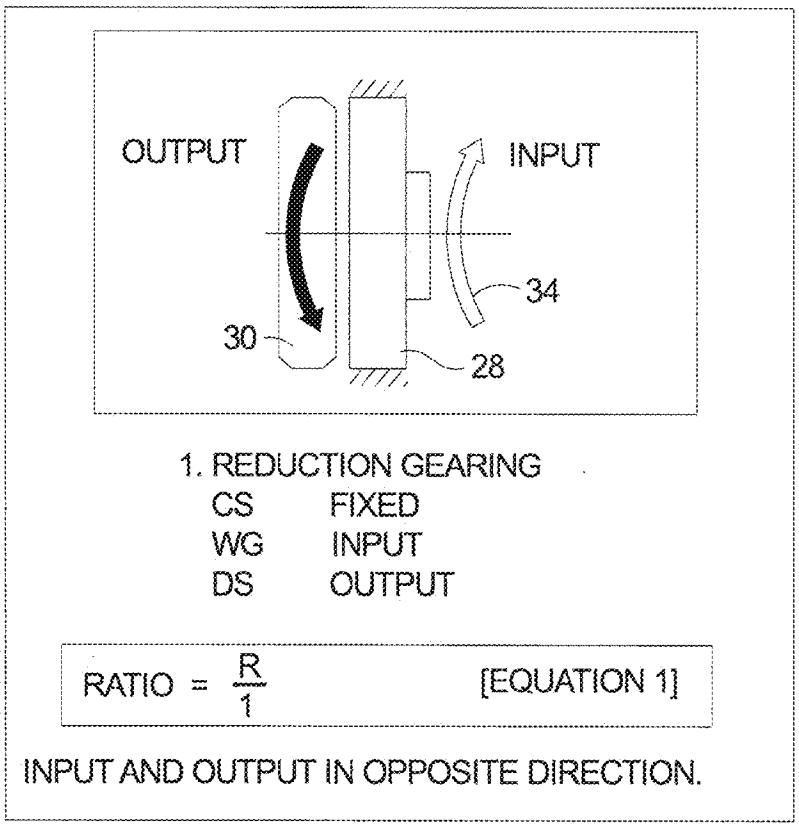
FIG. 5 is a schematic drawing showing a first gearing relationship in an eVCP, referred to herein as the baseline splines arrangement, wherein the dynamic spline drives the camshaft and the circular spline is driven by the sprocket.

Referring now to FIGS. 5 and 6, an advantage of a flat harmonic gear drive unit such as unit 12, as opposed to a cup-type unit such as is disclosed in the incorporated reference, is that unit 12 may be installed in either of two orientations within sprocket housing 36. In the baseline splines arrangement (FIG. 5), first or input spline 28 is the circular spline and is connected to sprocket housing 36, and second spline 30 is the dynamic spline and is connected to hub 20. In the inverted splines arrangement (FIG. 6), first spline 28 is the dynamic spline and is connected to sprocket housing 36, and second spline 30 is the circular spline and is connected to hub 20.

Fail-safe performance of the harmonic gear drive unit in eVCP 10 is not identical in the two orientations. Thus, a desired orientation may be selected during installation to minimize the response time for eVCP 10 to return to a preferred default position when eMotor 14 is de-energized when the engine is shut down or as a fail-safe response when eMotor experiences a failure (unintentionally energized or de-energized). In both orientations, the output gear, which is second spline 30 rotates with respect to first spline 28. When the circular spline is first spline 28 and the dynamic spline is the second spline 30, as shown in FIG. 5 (baseline arrangement), the dynamic spline rotates in a direction opposite from the input direction of the wave generator; however, when the dynamic spline is first spline 28 and the circular spline is the second spline 30, as shown in FIGS. 2 and 6 (inverted arrangement), the circular spline is the output gear and rotates in the same direction as the input direction of the wave generator.

Referring to FIG. 7, it is seen that if an exemplary eVCP is equipped with both a bias spring 24 and also a fail-safe electromagnetic brake (not shown but known in the art) on eMotor 14, the baseline spline arrangement shown in FIG. 5 is preferred because the failsafe advance time upon loss of power is minimized.

Referring to FIG. 8, it is seen that if an exemplary eVCP is equipped with a bias spring 24 but without a fail-safe electromagnetic brake on eMotor 14, the inverted spline arrangement shown in FIG. 6 is preferred because the fail-safe advance time upon loss of power is minimized.

According to the present invention, the harmonic gear drive unit 12 is configured such that an energy recovering mode is provided wherein a braking torque is applied to the control shaft 45 of the eMotor 14 in order to generate electrical energy.

Advantageously, the braking torque is applied to the control shaft 45 during phase holding modes, said braking torque compensating the camshaft friction torque on the control shaft 45.

Figure 9:
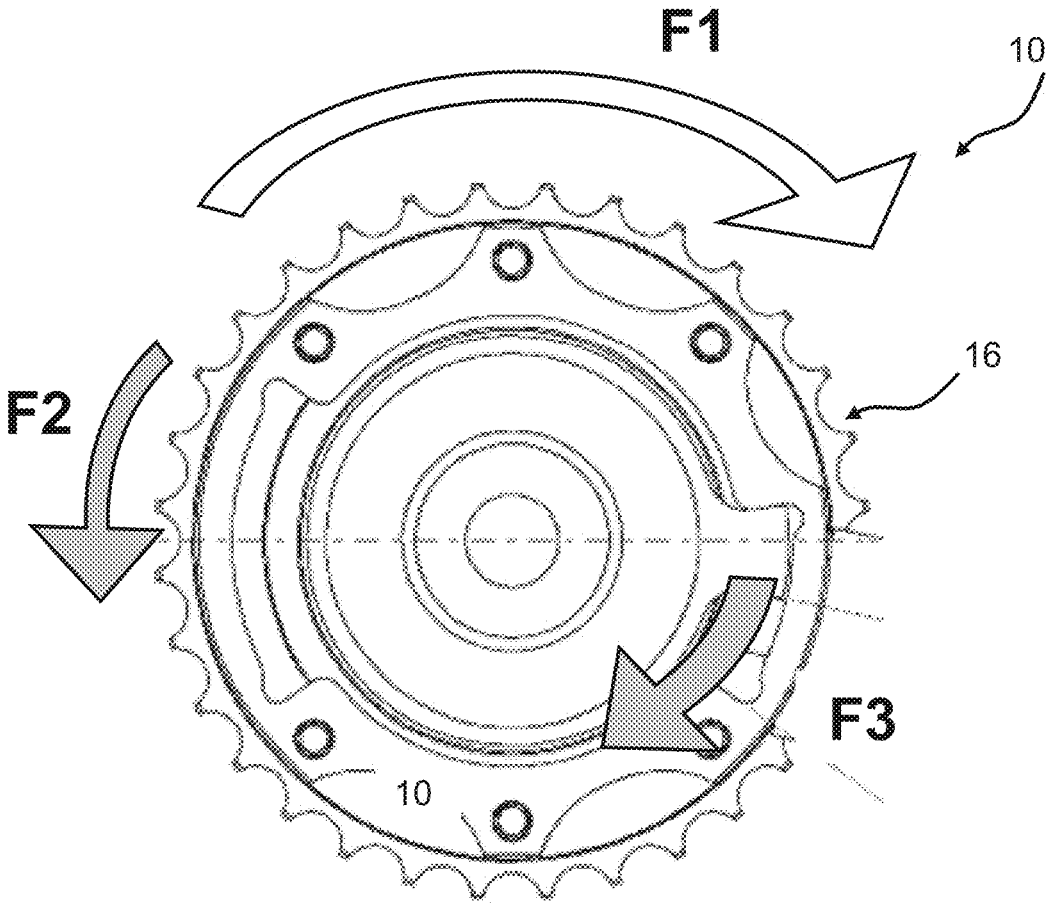
FIG. 9 is a front view of the eVCP of the invention showing rotational directions of several components for a baseline spline arrangement.

Preferably, the harmonic gear drive unit 12 is configured such that the control shaft 45 is rotating in an opposite direction to the camshaft 22 in order to provide electrical energy generation by recovery of mechanical camshaft frictions losses. This is the case with the baseline splines arrangement of FIG. 5 as it will be explained in connection with FIG. 9.

With the baseline splines arrangement, to keep the camshaft position fixed, (no phasing), the input shaft speed, i.e. control shaft speed, and the output shaft speed, i.e. camshaft speed, need to be equal by synchronizing the control shaft speed to the camshaft speed. Because of mechanical frictions on the camshaft 22, even if the sprocket 16 is driving the camshaft 22 in the direction of F1 (clockwise on FIG. 9), there is a negative torque created in the direction F2 (counter clockwise). This negative torque tends to accelerate the rotational speed of the control shaft 45. Braking the rotation of the control shaft 45 creates a torque in the opposite direction F3 to said negative torque generating electrical energy through the electrical machine 14.

While the invention has been described by reference to various specific embodiments, it should be understood that numerous changes may be made within the spirit and scope of the inventive concepts described. More particularly, the fail-safe arrangement could be omitted or could be designed differently of the embodiment shown on the figures. Also, the three shafts transmission could comprise a planetary gear system instead of the harmonic drive system. Accordingly, it is intended that the invention not be limited to the described embodiments, but will have full scope defined by the language of the following claims.

The invention claimed is:

1. An electrical camshaft phaser arrangement for controllably varying the phase relationship between a crankshaft and a camshaft in an internal combustion engine, comprising:

an adjusting gear drive unit formed as a three shafts transmission, comprising:

a drive shaft connected with the crankshaft;

an output shaft connected with the camshaft; and an adjusting shaft connected with a control shaft of an electrical machine, the electrical machine allowing phasing the camshaft with regards to the crankshaft by increasing or decreasing a control shaft speed, the control shaft being spinning during phase holding modes;

wherein the adjusting gear drive unit is configured such that an energy recovering mode is provided wherein a braking torque is applied to the control shaft in order to generate electrical energy, said braking torque being applied to the control shaft during phase holding modes, said braking torque compensating a camshaft friction torque on the control shaft.

2. The arrangement of claim 1 wherein the adjusting gear drive unit is configured such that the control shaft is rotating in an opposite direction to the camshaft in order to provide electrical energy generation by recovery of mechanical camshaft frictions losses.

3. The arrangement of claim 2 wherein the adjusting gear drive unit is a harmonic gear drive unit including a circular spline and a dynamic spline, a flexspline disposed within said circular spline and said dynamic spline, and a wave generator disposed within said flexspline, said electrical machine being connected to said wave generator.

4. The arrangement of claim 3 further comprising at least one spring operationally connected to said circular spline and to said dynamic spline for urging one of said circular and dynamic splines to move the camshaft phaser to a default rotational position.

5. The arrangement of claim 1 wherein the adjusting gear drive unit is a harmonic gear drive unit including a circular spline and a dynamic spline, a flexspline disposed within said circular spline and said dynamic spline, and a wave generator disposed within said flexspline, said electrical machine being connected to said wave generator.

6. The arrangement of claim 5 further comprising at least one spring operationally connected to said circular spline and to said dynamic spline for urging one of said circular and dynamic splines to move the camshaft phaser to a default rotational position.

7. The arrangement of claim 1 wherein said electrical machine is a DC axial-flux motor.

8. A control method for an electrical camshaft phaser arrangement according to claim 1, comprising the steps of:

increasing or decreasing control shaft speed in order to phase the camshaft, maintaining control shaft speed in order to hold a phase between the crankshaft and the camshaft, and energy loss recovering by applying a braking torque on the control shaft in order to generate electrical energy, said energy loss recovering step being implemented during phase holding in order to compensate a camshaft friction torque.

9. A control method for an electrical camshaft phaser arrangement for controllably varying the phase relationship between a crankshaft and a camshaft in an internal combustion engine, the camshaft phaser arrangement having an adjusting gear drive unit formed as a three shafts transmission, comprising a drive shaft connected with the crankshaft, an output shaft connected with the camshaft, and an adjusting shaft connected with a control shaft of an electrical machine, the electrical machine allowing phasing the camshaft with regards to the crankshaft by increasing or decreasing control shaft speed, the control shaft being spinning during phase holding modes, the control method comprising the steps of:

increasing or decreasing the control shaft speed in order to phase the camshaft, maintaining control shaft speed in order to hold a phase between the crankshaft and the camshaft, and energy loss recovering by applying a braking torque on the control shaft in order to generate electrical energy, said energy loss recovering step being implemented during phase holding in order to compensate a camshaft friction torque.

* * * * *